US009305448B2

(12) United States Patent
Mahmud et al.

(10) Patent No.: US 9,305,448 B2
(45) Date of Patent: Apr. 5, 2016

(54) SECURING DISTRIBUTION LINES FROM PILFERAGES

(71) Applicants: Sahibzada Ali Mahmud, Peshawar (PK); Gul Muhammad Khan, Peshawar (PK)

(72) Inventors: Sahibzada Ali Mahmud, Peshawar (PK); Gul Muhammad Khan, Peshawar (PK)

( * ) Notice: Subject to any disclaimer, the term of this patent is extended or adjusted under 35 U.S.C. 154(b) by 0 days.

(21) Appl. No.: 14/245,701

(22) Filed: Apr. 4, 2014

(65) Prior Publication Data

US 2015/0287309 A1 Oct. 8, 2015

(51) Int. Cl.
*G08B 13/12* (2006.01)
*G08B 13/26* (2006.01)

(52) U.S. Cl.
CPC ..... *G08B 13/26* (2013.01)

(58) Field of Classification Search
CPC ..... G08B 13/1409; G08B 13/1418; G08B 15/05; G06F 21/88; H02H 7/26; H04L 12/2803; H04L 12/2827; H04L 12/40078; H04L 12/40117
See application file for complete search history.

(56) References Cited

U.S. PATENT DOCUMENTS

| | | | | |
|---|---|---|---|---|
| 5,392,029 | A * | 2/1995 | Chang | 340/574 |
| 5,801,617 | A * | 9/1998 | Langner et al. | 340/426.31 |
| 8,860,580 | B1 * | 10/2014 | Wong | 340/660 |
| 2008/0109387 | A1 * | 5/2008 | Deaver et al. | 705/412 |

OTHER PUBLICATIONS

James, G., Cable TV Company Goes After Pirates, in One Zap, Published Apr. 25, 1991, The New York Times.*

* cited by examiner

*Primary Examiner* — Kerri McNally
*Assistant Examiner* — Renee Dorsey
(74) *Attorney, Agent, or Firm* — Sarfaraz K. Niazi

(57) ABSTRACT

The instant invention provides a smart system for securing distribution lines from malicious activities in the electricity distribution system, ultimately influencing the power sector in a positive way. The system architecture comprises two major parameters including distribution box and service box contributing mainly to the focal purpose of the system. The system is designed intelligently to improve and impede the process of theft control. The distribution box is designed to provide a high frequency signal having high voltage spikes on the distribution lines.

2 Claims, 2 Drawing Sheets

SECURING DISTRIBUTION LINES FROM PILFERAGES

BACKGROUND OF THE INVENTION

Electricity theft has always been one of the crucial problems in today's world of energy crises. For this reason, securing distribution lines becomes the utmost obligation of the power sector. Electricity blackout and high electricity charges resulting from various kinds of electrical thefts can be alleviated only by putting forth an effective solution of controlling it. A system needs to be developed that can not only detect the theft location but also cope with its off-putting effects. The instant invention presents a plan to address this situation. The plan involves securing the distribution lines efficiently and strategically by affecting the appliances with a high voltage shot or fluctuations in regular voltage if tried to get it directly from the distribution lines through meter bypassing.

SUMMARY OF THE INVENTION

The instant invention is a smart approach in securing distribution lines and alleviation of electricity theft by fixing it at the user premises. The basic idea is that electricity obtained by passing electricity meter or other means, the voltage supplied will not be regular containing many high frequency components that can damage electrical appliances, thus the culprit will not try again. At first the culprit will be warned of the consequences but, if the culprit continues trying to bypass the electric meter, the culprit will be charged in the form of damaged electrical appliances. This step involves the activation and deactivation of specific modules on the distribution lines supplying the high voltage shots.

The system architecture is simple comprising two main units i.e., a distribution box and a service box. The distribution box comprises a clipper and a high pass filter. The clipper clips the high voltage from the 11 Kv lines to regular 50 Hz 220 volts or 60 Hz 110 volts but at the same time introduces many harmonics of the fundamental frequency for the application i.e., 50 Hz or 60 Hz. The distribution box also comprises a high pass filter which passes only high frequency components to distribution lines. Thus a high frequency signal resides on the distribution lines. If someone attempts to bypass the meter, that person will be issued a warning signal for a period of time and if the culprit continues trying to bypass the meter, the distribution box will be activated. High voltage shots present on the distribution lines will damage the electrical appliances at the premises. The distribution lines concentrate at the service box, which will be automatically activated along with the distribution box. The service box contains a band pass filter that allows only the legitimate range of frequency components to provide a safer and regular voltage to the normal users connected to the service lines. System architecture for both the layouts of the system is presented i.e., with meters and without meters. For the systems with smart meters, the service box is mounted on the smart meters while for the systems without meters it is set up on the service point where users are connected through the service lines.

BRIEF DESCRIPTION OF THE DRAWINGS

Referring now to the figures, the following reference numbers may refer to elements of the invention:

10: is the overall secure distribution line system;

12: is the distribution box (DB); and,

14: is the service box (SB).

Figure 1:
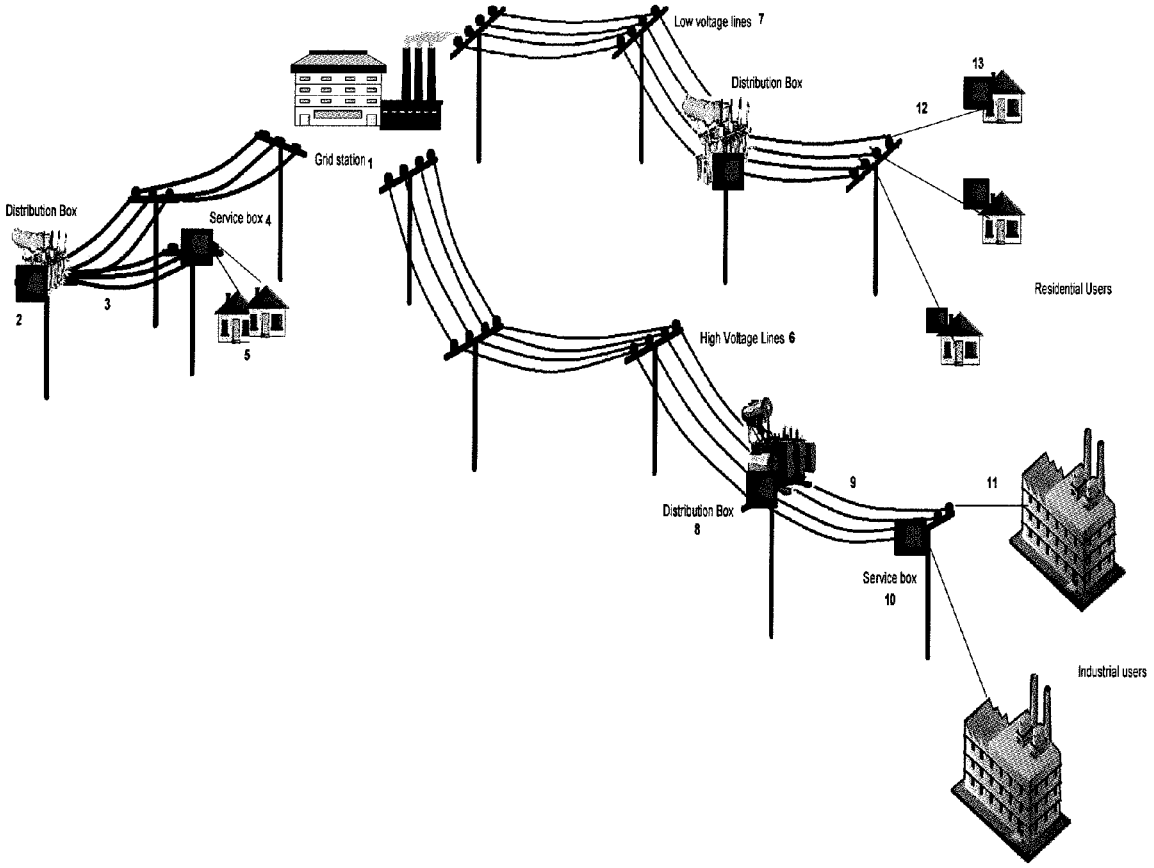

FIG. 1 depicts the overall architecture of the proposed system.

Figure 2:
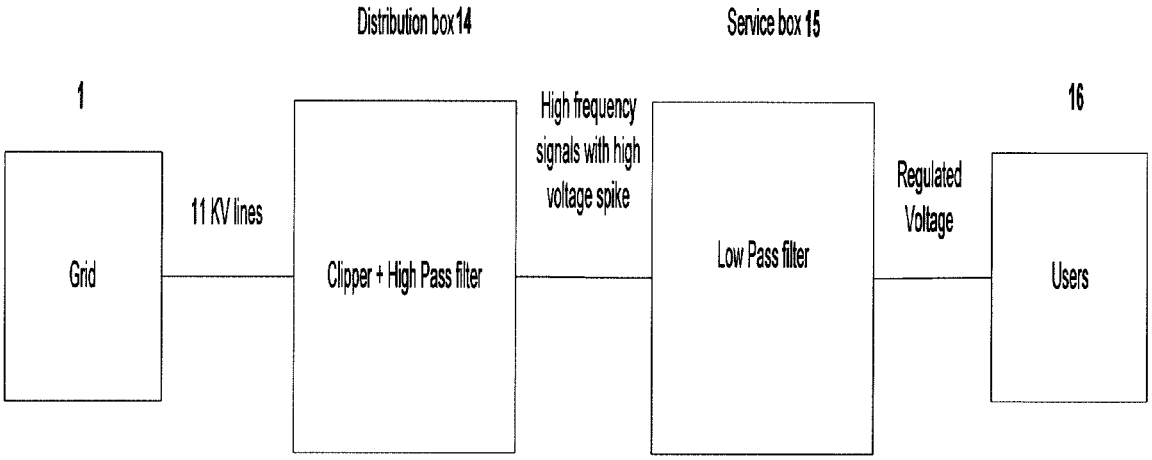

FIG. 2 depicts the block diagram representation of the system.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

The instant invention is a system for intelligently securing the distribution lines as shown and described. The plan comprises a counter strategy to handle electricity theft smartly. This not only helps to save energy but also reduces cost, and increases efficiency and transparency.

The system architecture comprises two major units i.e., a distribution box and a service box. The general architecture of the electric grid comprises transmission lines and distribution lines. Transmission lines are high voltage lines used for long distance electricity supply. Distribution lines forming the basic electricity network, supply electricity to the consumers including domestic and industrial users.

Distribution lines can be both high voltage lines and low voltage lines. The transformer on distribution lines decides the voltage level supplied to various consumers according to their needs. Theft usually happens on distribution lines where illegal connection is directly made. The proposed system is a smart approach towards mitigating electricity theft. The system includes the issuance of a warning signal to the thief at his first attempt but if the culprit continues attempting to make an illegal connection for a certain time span, the culprit is subjected to a penalty in the form of damaged electrical appliances.

The system introduces two basic entities in the architecture to cope with electricity theft. A distribution box is mounted on the distribution lines with the transformer. This distribution box consists of a clipper and a high pass filter. The clipper clips off the signal and introduces higher harmonic of the system. The basic aim is to generate the shot of up to ten times greater than the normal voltage on the distribution line. For that purpose up to 50th harmonic of the fundamental frequency of the system is required. This generates a high voltage shot on the distribution line sufficient for damaging the electric equipment at the user's premises. The system very smartly manages the regular voltage supply to the normal user. This is accomplished by using a service box before supplying power on service lines. The service box consists of a band pass filter, which filters out the unwanted high frequency components and allow only the safe and legitimate range of voltage of normal 110 volts or 220 volts, 50 Hz or 60 Hz signal on service lines. The distribution box and the service box are activated after the period specified for the warning expires.

FIG. 1 illustrates the overall embodiment of the system comprising several structural components 1, 2, 3, 4, 5, 6, 7, 8, 9, 10, 11, 12, 13, 14 and 15 at various levels. Two major types of loads are shown i.e., high voltage loads and low voltage loads. High voltage loads such as used by industries are connected to high voltage lines 6 and low voltage loads like residential area is connected to low voltage lines 7. The figure depicts two kinds of metering infrastructure, one without meter 6, 12 and other with meters 7. Loads without meters are connected to lines 6, 12. Residential users without meters are connected to the service lines directly. A detailed description of the system without meters is provided in U.S. patent application Ser. No. 13/752,425, entitled "I-DETECT: Intelligent Detection of Electricity Theft using Enhanced Communication Technology" which incorporates herein by reference in its entirety for the purpose of explaining system for secure distribution lines for meter less infrastructure. Referring to U.S. patent application Ser. No. 13/752,425, the service box here is mounted on the main service point from where services lines for various users are distributed. The service box 4 and distribution Box 2 are connected through distribution lines 3. The distribution box 2 contains a high pass filter that allows only high frequency components to distribution lines 3. A high frequency signal exists on the distribution lines. So the person committing theft is caught and subjected to the consequences. High voltage shots damage the electrical appliances at the user premises. The distribution boxes 2 are mounted with the transformers and getting power from High tension lines that come from the grid station 1. High voltage lines 6 connecting higher voltage loads are managed in the same manner. It also has the same entities distribution box 8, distribution lines 9, service box 10 and service lines 11 as the low Voltage lines working in the same way. Users with meters are connected to low voltage lines 7 through service lines 12. A service box is mounted with the meter 13 that regularizes the voltage supply to end users.

FIG. 2 illustrates another preferred embodiment of the block diagram of the system. High tension lines from the grid station 1 are transformed to the low tension distribution lines and service lines for individual users. The distribution box 14 contains the clipper and high pass filter to provide a high harmonic signal on distribution line with high voltage spike. This signal with high frequency components is regularized by passing through a band pass filter in service box 15. The service box can either be mounted on the meters at home or on the service lines. The service box provides normal regular voltage to the users 16.

The system provides an efficient solution that addresses the major problem of electricity theft. The system addresses these issues by giving an effective solution to counter thefts. The system addresses the problem of meter bypassing. Many solutions are proposed and systems are developed to detect meter bypassing but how to reduce it and handle it once it is done, still needs to be considered. This invention is an effort to reduce these theft related issue.

The system provides a smart solution to minimize the frequency of occurrence by teaching a lesson to the thief by damaging all its electronic equipment by sending a high voltage spike. Load shedding and billing irregularities can be automatically reduced by controlling electricity theft. Apart from providing comfort to the consumer sides, the revenue losses of distribution company will be greatly reduced. The system presents a more promising and efficient solution to curb the current electricity glitches.

What is claimed is:

1. A system for securing distribution lines to avoid theft of electricity comprising:

a distribution box on distribution lines including:

a circuitry to introduce high voltage shots on distribution lines;

a service box including a filter to provide normal voltage to paying users;

wherein a warning signal alerts a perpetrator that his/her attempt to steal electricity has been detected followed by a penalty in the form of a high voltage shot to damage appliances using the stolen electricity; and, wherein the high voltage shot has high frequency harmonics.

2. A system for securing distribution lines to avoid theft of electricity comprising:

a distribution box on distribution lines including:

a circuitry to introduce high voltage shots on distribution lines;

a service box including a filter to provide normal voltage to paying users;

wherein a warning signal alerts a perpetrator that his/her attempt to steal electricity has been detected followed by a penalty in the form of high voltage shot to damage appliances using the stolen electricity; and, wherein the voltage shot with high frequency harmonics are sent to disable and to damage the non-resistive load that is running on the stolen electricity.

* * * * *